US011717133B2

(12) United States Patent
Boyer et al.

(10) Patent No.: US 11,717,133 B2
(45) Date of Patent: Aug. 8, 2023

(54) DISHWASHER WITH ROTARY BLISTER PACK DISPENSER

(71) Applicant: Midea Group Co., Ltd., Foshan (CN)

(72) Inventors: Joel Boyer, Louisville, KY (US); Bassam Fawaz, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 204 days.

(21) Appl. No.: 17/038,032

(22) Filed: Sep. 30, 2020

(65) Prior Publication Data

US 2022/0095885 A1 Mar. 31, 2022

(51) Int. Cl.
*A47L 15/44* (2006.01)

(52) U.S. Cl.
CPC ..... *A47L 15/4472* (2013.01); *A47L 15/4463* (2013.01)

(58) Field of Classification Search
CPC ..... A47L 15/4472; A47L 15/4463; A47L 15/4445
See application file for complete search history.

(56) References Cited

U.S. PATENT DOCUMENTS 3,212,675 A 10/1965 Thomas
3,233,778 A 2/1966 Cobb
4,938,125 A 7/1990 Wong
5,464,118 A * 11/1995 Grau ..... B65D 83/0463 221/88
6,062,420 A * 5/2000 Krouwel ..... B65D 83/0463 221/88
6,540,081 B2 4/2003 Balz et al.
7,472,710 B2 1/2009 Jowett et al.
8,146,610 B2 4/2012 Gibis et al.
8,221,696 B2 7/2012 Brandt et al.
8,338,357 B2 12/2012 Gibis et al.
8,506,896 B2 8/2013 Hofte et al.
8,651,336 B2 2/2014 Gadini et al.
2002/0108969 A1 8/2002 Rodd et al.
2004/0088796 A1 5/2004 Neergaard et al.
2005/0082308 A1 4/2005 Simson
2008/0293604 A1 11/2008 Gibis et al.
2010/0104488 A1 4/2010 Housmekerides et al.
2011/0087367 A1 4/2011 Gadini et al.
(Continued)

FOREIGN PATENT DOCUMENTS

CN 104631056 A 5/2015
CN 109199297 A 1/2019
(Continued)

OTHER PUBLICATIONS

U.S. Patent and Trademark Office, Office Action issued in U.S. Appl. No. 16/448,798 dated Feb. 23, 2021.
(Continued)

*Primary Examiner* — Joseph L. Perrin
*Assistant Examiner* — Irina Graf
(74) *Attorney, Agent, or Firm* — Gray Ice Higdon

(57) ABSTRACT

A dishwasher with a rotary multiple use detergent dispenser is disclosed. The rotary multiple use detergent dispenser may include a blister pack having a plurality of detergents. One or more components of the detergent dispenser may be used to dispense/expel the plurality of detergents from the blister pack into a wash tub of the dishwasher.

15 Claims, 5 Drawing Sheets

(56) References Cited

U.S. PATENT DOCUMENTS

| | | | | |
|---|---|---|---|---|
| 2011/0189060 | A1 | 8/2011 | Van Loyen et al. | |
| 2011/0259368 | A1 | 10/2011 | Hofte et al. | |
| 2011/0272435 | A1 | 11/2011 | Brandt et al. | |
| 2013/0137621 | A1* | 5/2013 | Kessler | B65D 83/00 510/293 |
| 2015/0359412 | A1* | 12/2015 | Delgado | A47L 15/4463 134/198 |
| 2016/0145548 | A1 | 5/2016 | Van Tol et al. | |
| 2020/0397219 | A1 | 12/2020 | Fawaz et al. | |

FOREIGN PATENT DOCUMENTS

| | | | | | |
|---|---|---|---|---|---|
| DE | 10158604 | A1 | | 6/2003 | |
| DE | 102004020476 | A1 | | 11/2005 | |
| DE | 102010003775 | A1 | | 10/2011 | |
| GB | 2386129 | A | | 9/2003 | |
| GB | 2417492 | A | * | 3/2006 | A47L 15/4463 |
| IT | 1245009 | B | * | 9/1994 | A47L 15/44 |
| WO | WO 03073906 | A1 | | 9/2003 | |
| WO | WO2010142723 | A1 | | 12/2010 | |
| WO | WO2012025315 | A1 | | 3/2012 | |
| WO | WO2013113576 | A1 | | 8/2013 | |
| WO | WO2017050538 | A1 | | 3/2017 | |

OTHER PUBLICATIONS

U.S. Patent and Trademark Office, Notice of Allowance issued in U.S. Appl. No. 16/448,798 dated Jun. 1, 2021.

Finish Quantumatic Finish Quantumatic Automatic Dishwasher Detergent Dispenser System By Finish, https://www.amazon.com/Finish-Quantumatic-Automatic-Dishwasher-Detergent/dp/B003GEQVTQ, Retrieved on Apr. 20, 2020.

* cited by examiner

DISHWASHER WITH ROTARY BLISTER PACK DISPENSER

BACKGROUND

Dishwashers are used in many applications to clean dishes, silverware, cutlery, cups, glasses, pots, and pans, etc. Most conventional dishwashers rely on a single-use detergent dispenser, often located on the interior of the door of the dishwasher. Such conventional dispensers include an opening allowing for a volume of liquid, powder, dissolvable pods, or capsule detergent to be loaded for a single washing cycle. During the washing cycle, such a dispenser is opened to allow the entirety of the detergent therein to be expelled. As such, a user is required to reload the dispenser before each washing cycle. Because of the necessity of handling the detergent each and every time for a new washing cycle, this filling process of the conventional dishwasher dispenser can be inconvenient. In certain instances, it may be desirable to minimize the number of times the user is required to fill the dispenser.

Thus, there is a need in the art to improve the existing detergent dispensers.

SUMMARY

The herein-described embodiments address these and other problems associated with the art by providing a dishwasher with a rotary multiple use detergent dispenser. The present disclosure is related to an apparatus for receiving and holding a blister pack with a plurality of detergents compositions and/or additives and for individually dispensing the detergent into an automatic dishwasher over a plurality of washing cycles.

In some embodiments, a dishwasher may include a wash tub and a detergent dispenser positioned in the wash tub to dispense detergent into the wash tub. The detergent dispenser may include a driving mechanism with a rotating shaft defining a rotational axis, an elongated member having a first end coupled to the rotating shaft and a second end projecting radially outward therefrom, a track plate having a first side, a second side, and a curved track therein disposed about the rotational axis. The curved track may be used for receiving the second end of the elongated member. The detergent dispenser may also include a backing plate having a first side and a second side, and the backing plate may have one or more outlets on the second side therethrough in fluid communication with the wash tub. The detergent dispenser may also include a blister pack for coupling between the second side of the track plate and the first side of the backing plate, and the blister pack may have a plurality of detergents arranged in a configuration complementary to the curved track. The driving mechanism may rotate the elongated member on the first side of the track plate with respect to the track plate and the blister pack together along a plurality of rotational positions following the curved track, and one or more of the plurality of rotational positions may orientate the second end of the elongated member proximate the plurality of detergents to dispense detergent into the wash tub through the one or more outlets of the backing plate.

In some embodiments, a dishwasher may include a wash tub and a detergent dispenser positioned in the wash tub to dispense detergent into the wash tub. The detergent dispenser may include a driving mechanism with a rotating shaft defining a rotational axis, an elongated member having a first end coupled to the rotating shaft and a second end projecting radially outward therefrom, a track plate having a curved track therein disposed about the rotational axis. The curved track may be used for receiving the second end of the elongated member. The detergent dispenser may also include a backing plate having one or more outlets in fluid communication with the wash tub. The detergent dispenser may also include a blister pack for coupling between the track plate and the backing plate, and the blister pack may have a plurality of detergents arranged in a configuration complementary to the curved track. The driving mechanism may rotate the blister pack with respect to the track plate and the elongated member together along a plurality of rotational positions following the curved track, and one or more of the plurality of rotational positions may orientate the second end of the elongated member proximate the plurality of detergents to dispense detergent into the wash tub through the one or more outlets of the backing plate.

In some embodiments, a dishwasher may include a wash tub and a detergent dispenser positioned in the wash tub to dispense detergent into the wash tub. The detergent dispenser may include a track plate having a track thereon, a blister pack having a plurality of detergents arranged in a configuration complementary to the track, a backing plate adjacent one side of the blister pack and having one or more outlets in fluid communication with the wash tub, a member adjacent the other side of the blister pack and configured to move following the track, and a driving mechanism driving the member among a plurality of track positions. The one or more of the plurality of track positions may orientate the member proximate the plurality of detergents to dispense detergent into the wash tub through the one or more outlets of the backing plate.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above-outlined features are to be understood as exemplary only, and many more features and objectives of the various embodiments may be gleaned from the disclosure herein. Therefore, no limiting interpretation of this summary is to be understood without further review of the entire specification, claims, and drawings included herewith. A more extensive presentation of features, details, utilities, and advantages of the present disclosure is provided in the following written description of various embodiments of the disclosure, illustrated in the accompanying drawings, and defined in the appended claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosure

DETAILED DESCRIPTION

Figure 1:
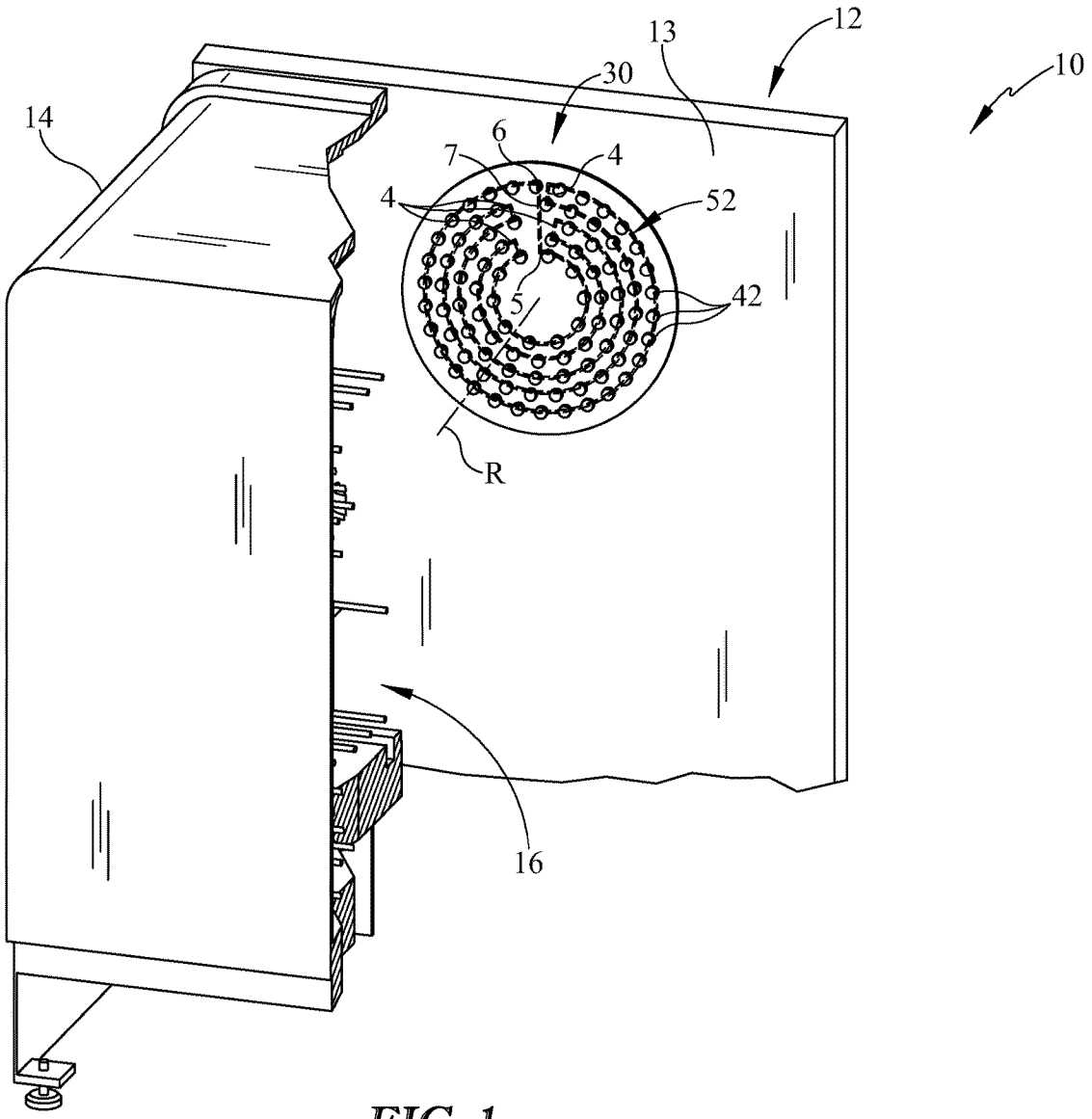
FIG. 1 is a partial rear perspective interior view of a dishwasher illustrating an example detergent dispenser within an interior of dishwasher door, according to an embodiment of the present disclosure.

It is to be understood that a dishwasher with a rotary multiple use detergent dispenser is not limited in its application to the details of construction and the arrangement of components set forth in the following description or illustrated in the drawings. The described embodiments are capable of other configurations and of being practiced or of being carried out in various ways. Also, it is to be understood that the phraseology and terminology used herein is for the purpose of description and should not be regarded as limiting. The use of "including," "comprising," or "having" and variations thereof is meant to encompass the items listed thereafter and equivalents thereof, as well as additional items. Unless limited otherwise, the terms "connected," "coupled," and "mounted," and variations thereof herein, are used broadly and encompass direct and indirect connections, couplings, and mountings. In addition, the terms "connected" and "coupled" and variations thereof are not restricted to direct physical or mechanical connections or couplings.

The embodiments discussed hereinafter will, for convenience only, focus on the implementation of the hereinafter-described techniques within a residential type dishwashing appliance with a hinged door. However, it will be appreciated that the herein-described techniques may also be used in connection with other types of kitchen appliances in some embodiments. For example, the herein-described techniques may be used in a commercial dishwashing application or other types of appliances (e.g., a washer) in some embodiments. Moreover, at least some of the herein-described techniques may be used in connection with other dishwasher configurations, including dishwashers utilizing sliding drawers or dish sink dishwashers, e.g., a dishwasher integrated into a sink.

Turning now to the drawings, wherein like numbers denote like parts throughout the several views, FIG. 1 illustrates an example dishwasher 10 in which the various technologies and techniques described herein may be implemented. The dishwasher 10 may be a residential-type built-in dishwasher, and as such includes a front-mounted door 12 that provides access to a wash tub 16 housed within the cabinet or housing 14. The door 12 may be generally hinged along a bottom edge and pivotable between an opened position (not shown) and a closed position as illustrated in FIG. 1. When the door 12 is in the opened position, access may be provided to one or more sliding racks, e.g., lower rack and upper rack, within which various utensils are placed for washing. The lower rack may be supported on rollers, while the upper rack may be supported on side rails, and each rack may be movable between loading (extended) and washing (retracted) positions along a substantially horizontal direction. Control over the dishwasher 10 by a user is generally managed through a control panel (not shown) typically disposed on a top or front of the door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a washing cycle. Additionally, the dishwasher 10 may include one or more rotating spray arms, e.g., lower spray arms, upper spray arm, or other sprayers, including various combinations of wall-mounted sprayers, rack-mounted sprayers, oscillating sprayers, fixed sprayers, rotating sprayers, focused sprayers, etc. However, this positioning is not intended to be limiting, as various sprayers may be positioned through the dishwasher.

In the embodiments of the present disclosure, the dishwasher 10 may include a detergent dispenser 30 with multiple dishwashing cycles' worth of detergent 2/compartments 3 within the detergent dispenser 30, so that it is not necessary for a user to add additional detergent before each dishwashing cycle. Such a detergent dispenser 30 may be positioned, as illustrated in FIG. 1, on an interior 13 of the door 12. However, this positioning is not intended to be limiting, and in some embodiments the detergent dispenser may be positioned in other locations within the dishwasher (e.g. interior walls of the wash tub 16) and still dispense detergent into the wash tub.

Figure 2A:
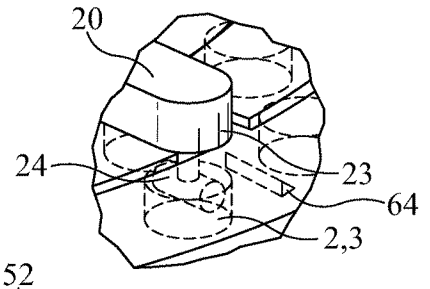
FIG. 2A is a partial perspective view illustrating a different dispensing device, according to an embodiment of the present disclosure.
Figure 2:
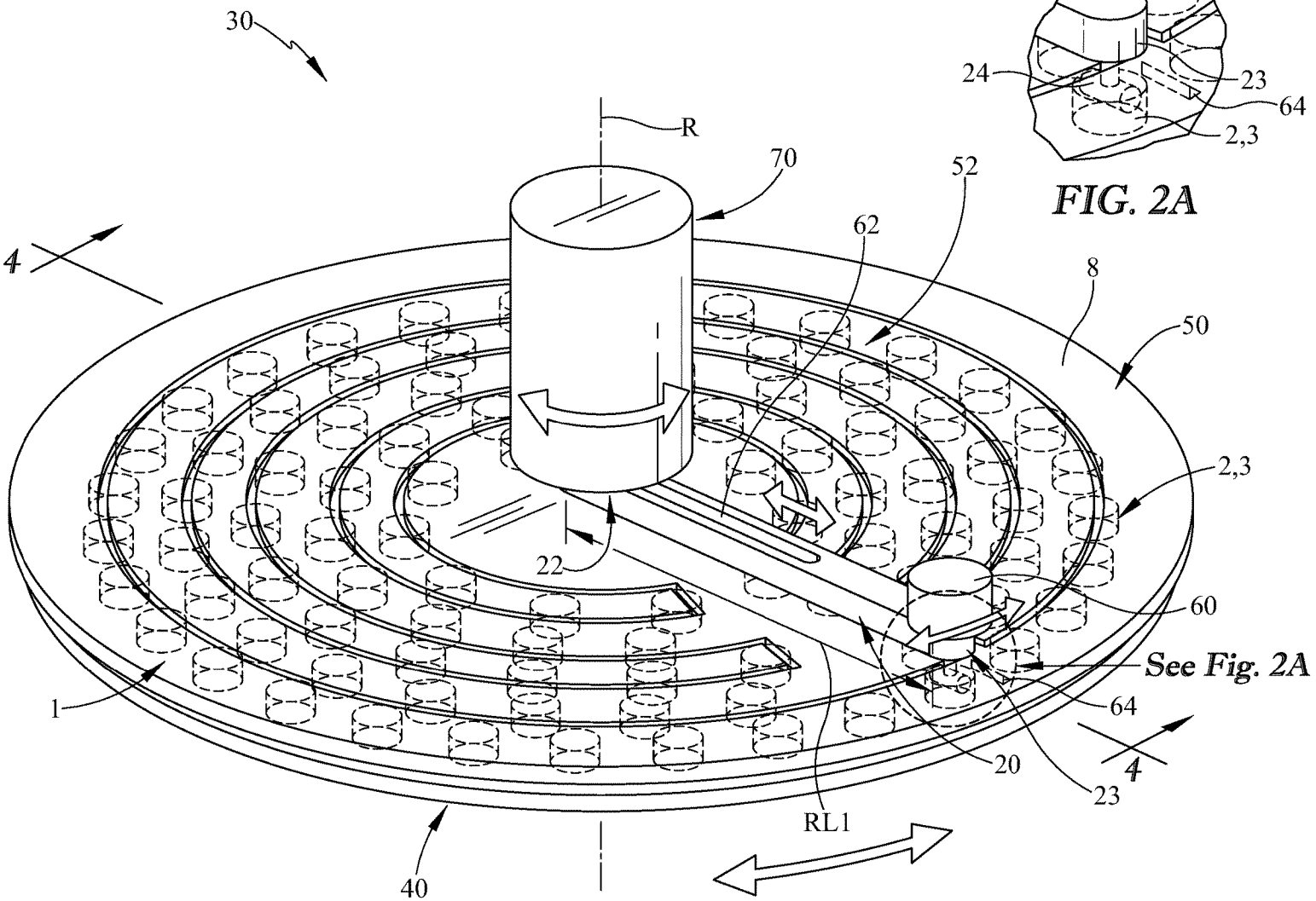
FIG. 2 is a perspective view of the detergent dispenser of FIG. 1 illustrating a blister pack in broken lines between a track plate and a backing plate, and an elongated member in a rotational position engaging/dispensing detergent at a starting point of a curved track, according to an embodiment of the present disclosure.
Figure 3A:
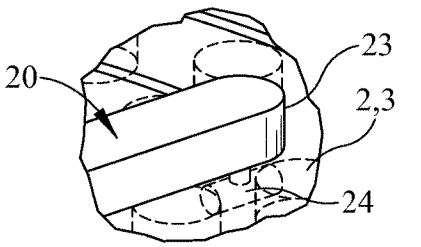
FIG. 3A is a partial perspective view illustrating a different dispensing device, according to an embodiment of the present disclosure.
Figure 3:
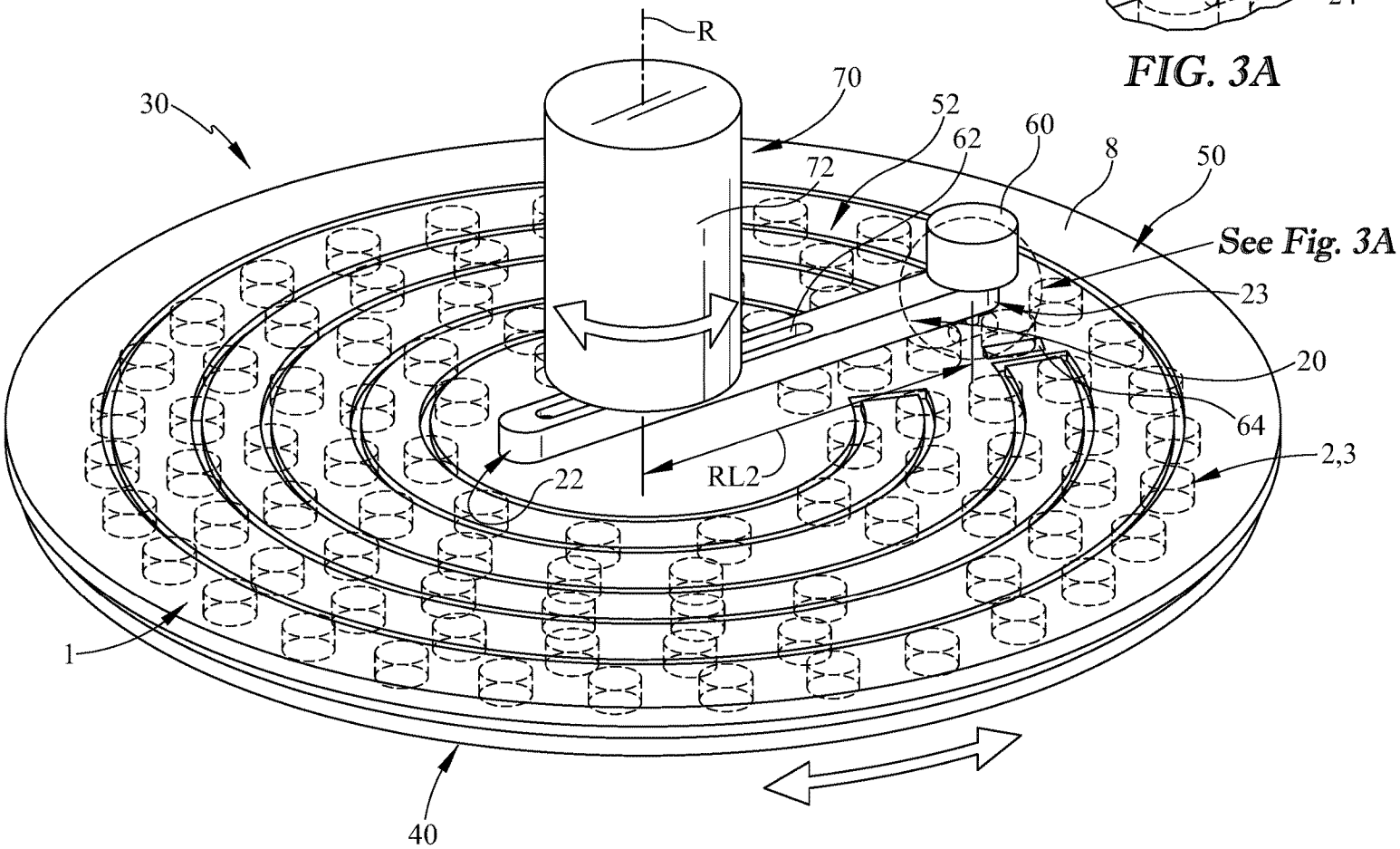
FIG. 3 is a perspective view of the detergent dispenser of FIG. 2 illustrating the elongated member in another rotational position engaging the blister/detergent at a smaller radius of the curved track during operation, according to an embodiment of the present disclosure.
Figures 4, 4A:
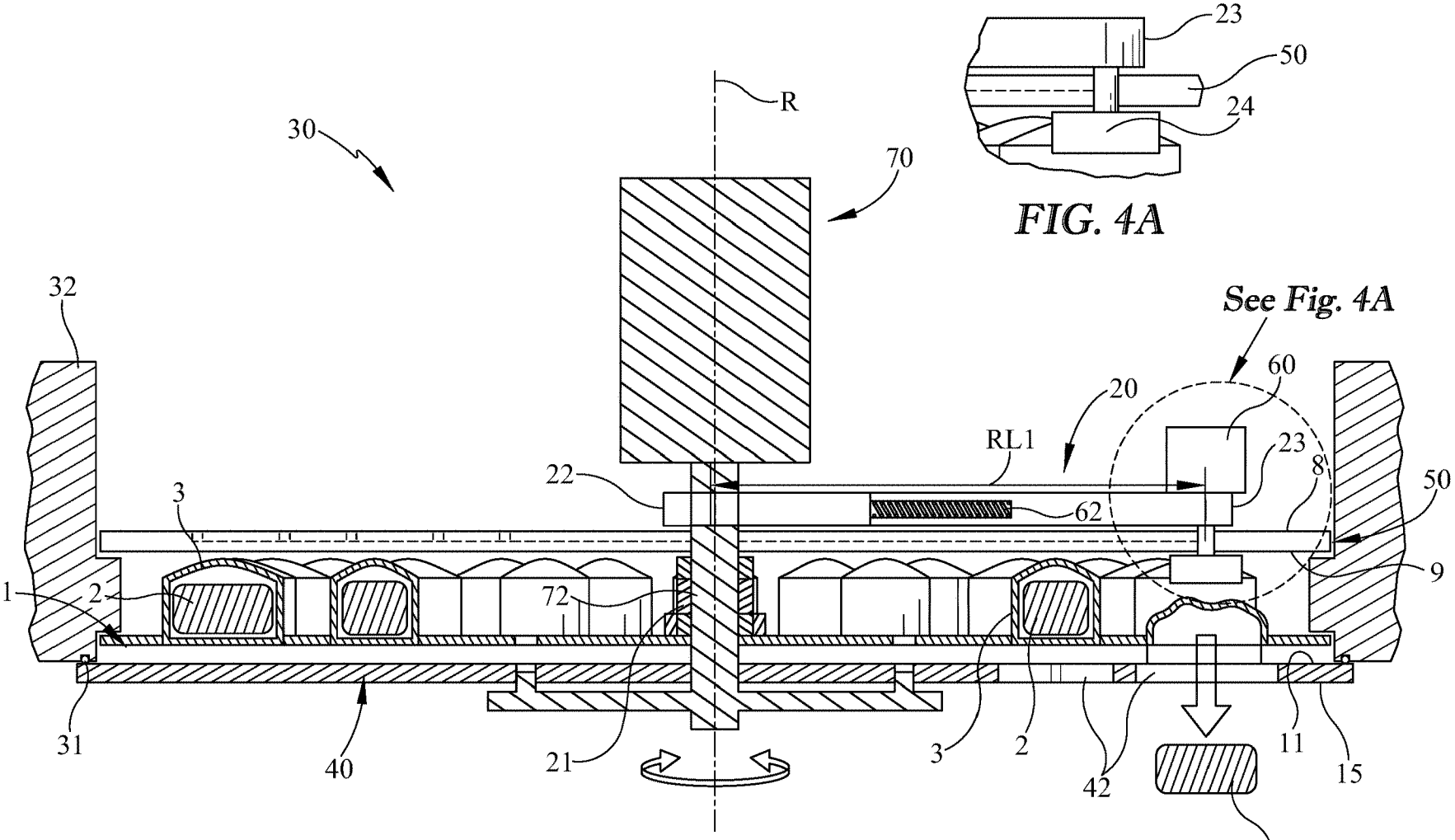
FIG. 4 is a sectional view taken along line 4-4 of FIG. 2, according to an embodiment of the present disclosure.
FIG. 4A is a partial sectional view illustrating a different dispensing device, according to an embodiment of the present disclosure.

Now turning to the FIGS. 2-4, which illustrate the interior of an example detergent dispenser 30 in which the various technologies and techniques described herein may be implemented. The detergent dispenser 30 may include a driving mechanism 70 driving a moving member 20 and/or a backing plate 40 to dispense one or more detergent 2 from one or more compartments 3 on a blister pack 1 located between a track plate 50 and a backing plate 40 into the wash tub 16. The track plate 50 may have a track 52 corresponding to the detergent 2/compartment 3 arrangement on the blister pack 1, and the member 20 and/or the backing plate 40 may be driven to one or more positions following the track 52 to orientate the member 20 and/or the backing plate 40 proximate the detergent 2/compartment 3 or the outlet 42 to expel the detergent 2 from the blister pack 1. The detergent 2 then may pass through the outlet 42 to be dispensed (e.g., under force of gravity) into the wash tub 16. Various embodiments of the detergent dispenser 30 will be discussed in detail below.

In some embodiments, as illustrated in FIGS. 2-4, the detergent dispenser 30 may include the driving mechanism 70 rotating an elongated member 20 and/or a circular backing plate 40, or other portions of the detergent dispenser 30. One embodiment of the driving mechanism 70 may be a DC electrical motor (e.g., a stepper motor) with a rotating shaft 72 (best shown in FIG. 4) defining and extending along a rotational axis R, and the shaft 72 may engage one or more portions of the detergent dispenser 30 (e.g. the elongated member 20, the backing plate 40, etc.) and rotate in one or more rotational directions. In some embodiments, as shown in FIGS. 2-3, the driving mechanism 70 may drive the elongated member 20 and/or the backing plate 40 to rotate about at least one rotational axis R between a plurality of rotational positions on the track 52 to dispense detergent 2 into the wash tub 16. It should be understood that the member 20 may be a variety of shapes, sizes, quantities, and constructions and still expel/dispense the one or more detergent 2 from the blister pack 1 or compartment 3 in one or more rotational positions into the wash tub 16. As discussed above, one embodiment of the member 20 may be in an elongated configuration with opposing ends. One or a first end 22 may be adjacent to and may engage the shaft 72 and the other or second end 23 may extend or project radially outward from the shaft 72 or the rotational axis R. When the shaft 72 rotates, the second end 23 may rotate about the shaft 72 or rotational axis R among the plurality of rotational positions or directions on the track 52.

In some embodiments, the detergent dispenser 30 may also include the track plate 50 with a first side 8 and a second side 9. The first side 8 may, for example, face the member 20, and the second side 9 may face the blister pack 1. As shown in FIGS. 2-3, the curved track 52 on the track plate 50 for receiving the second end 23 of the elongated member 20 may be built-in through the first side 8 and the second side 9 of the track plate 50 in a concentric circle configuration about the rotational axis R to provide a non-overlapping path for maximum coverage of the blister pack 1, with the inner circle having a smaller radius than the outer circle. In some embodiments as shown in FIG. 1, the end of each circle of the track 52 may include one or more linear radial offsets 4 to allow the elongated member 20 to transition to the next smaller inner circle during operation. The ending position of the innermost circle (i.e., a final position 5 of the curved track 52) may include an extended linear radial offset 7 to connect to the starting/initial position 6 of the curved track 52. In some embodiments, the extended linear radial offset 7 may be configured for a resetting operation, which will be discussed in detail below. It should be understood the locations of the starting position 6 and the final position 5 of the track 52 are not limited, and any other feasible locations may be acceptable. The elongated member 20 and/or the backing plate 40 may be driven by the driving mechanism 70 following the curved track 52 to a variety of rotational positions and/or radial positions about the rotational axis R in a continuous manner to engage the multiple detergent 2/compartments 3 in an arcuate or circumferential pattern within the blister pack 1. Accordingly, the blister pack 1 may have the same continuous non-overlapping concentric circle arrangement of the detergent 2/compartment 3 as shown in FIGS. 1-3. In such embodiments, the elongated member 20 may engage a plurality of detergents 2/compartment 3 along a plurality of radial distances from the rotational axis R for dispensing. It should be noted that any other feasible configuration for the track 52 and/or the blister pack 1 (e.g., un-curved) may be acceptable.

Besides the track plate 50, in some embodiments, the detergent dispenser 30 may include the backing plates 40 to support the blister pack 1 and/or compartments 3 of the blister pack 1 (e.g. when the compartment 3 with detergent 2 inside is engaged/disengaged by the elongated member 20) under compression. A first side 11 of the backing plate 40 may be positioned on or adjacent to at least one side of the blister pack 1, and a second side 15 of the backing plate 40 may proximate the wash tub 16. The backing plate 40 may include one or more outlets 42 on the second side 15 in communication with the wash tub 16. The outlet 42 of the backing plate 40 may be proximate the detergent 2/compartment 3 and/or the plurality of rotational positions or the elongated member 20. The shape of the outlet 42 are not limited, it being understood that the purpose of the outlet 42 is to receive therethrough the detergent 2.

As discussed above, in some embodiments, the detergent dispenser 30 may include one or more replaceable blister packs 1 located between the track plate 52 and the backing plate 40 on the door 12 of the dishwasher 10. More specifically, the blister pack 1 may be position between the second side 9 of the tracking plate 50 and the first side 11 of the back plate 40. Each blister pack 1 may be configured to hold a plurality of unit doses of detergent 2 within a plurality of compartments 3 for a variety of washing cycles. For example, the blister pack 1 may include a plurality of deep-drawn compartments 3 along the circumference thereof to receive and hold the detergent 2. The detergent 2 may include detergent of all varieties, including, but not limited to, liquid detergent, rinse aids, powder detergent, and/or dissolvable pod/capsule/tablet detergent. In some embodiments as shown here, the blister pack 1 may be in a circular or wheel-like configuration to match the configuration of the curved track 52. In some implementations of the blister pack 1, the compartment 3 may be formed on the blister pack 1 by positioning along one or more circumferences or arcuate paths thereof for receiving the tablets of detergent 2. For example, the detergent 2/compartment 3 may be arranged on the blister pack 1 in at least one circle about the rotational axis R along the circumference thereof, following the curved track 52 biased towards a smaller radius circle.

In use, the detergent 2 in the blister pack 1 may be protected from access of water or washing liquid until the point of time when ejection of the tablets/detergent 2 therefrom is desired. To accomplish this, the compartment 3 filled with detergent 2 may be made of waterproof plastic material. Alternatively, the compartment 3 may be constructed in a waterproof manner to avoid any access of water or washing liquid thereinto for protection of the detergent 2 stored therein. Meanwhile, the material of the compartment 3 is fragile for easy ejection, such as a foil or easy broken plastic material. To improve the ejection of the detergent 2 from the compartment 3 during operation of the dishwasher 10, weakening lines (not shown) or the like may be provided around or within each single compartment 3. In some embodiments, a blade 64 may be used in various embodiments to aid in the tearing/ejection of the blister or package. For example, as shown in FIGS. 2-3, the backing plate 40 may include one or more blades 64 adjacent one or more outlets 42 therein.

In some embodiments, the blister pack 1 may be stationary relative to one or more portions of the dispenser 30 (e.g. the elongated member 20, the backing plate 40, the track plate 50, the driving mechanism 70, etc.). Alternatively, in some other embodiments, the blister pack 1 may not be stationary (e.g. be able to move or rotate). For example, in some embodiments, the driving mechanism 70/the shaft 72 may engage the blister pack 1 and drive the blister pack 1 positioned between the track plate 50 and the backing plate 40 to rotate with respect to the elongated member 20 and the track plate 50 to a plurality of rotational positions about the rotational axis R in a continuous manner to engage the detergent 2/compartment 3, following the curved track 52, to dispense detergent through the outlet 42 on the backing plate 40 into the wash tub 16.

It should be understood that the blister pack 1 and/or portions thereof may be a variety of quantities, shapes, sizes, patterns of compartments/detergent, and constructions and still be within the scope of the present disclosure. It should be understood that alternative embodiments of the blister pack 1 may be acceptable. For example, the blister pack 1 may be comprised of a row of individually packaged compartments 3 formed into a loop. In such embodiments, the detergent dispenser 30 including the track plate 50 and the track 52 of the present disclosure may have a different shape/configuration, i.e. not circular, may be square. Any feasible forms, configurations, and shapes of the blister pack 1 and detergent dispenser 30 are within the scope of the present claims and may be considered as appropriate by someone skilled in the art.

During operation, in some embodiments, the member 20 or portions thereof may engage/disengage from the compartment 3 and/or expel the detergent 2 from the blister pack 1 via rotational movement (e.g. clockwise and/or counterclockwise), axial movement (e.g. parallel movement to the rotational axis away from or towards the blister pack), linear/radial movement away from or towards the rotational axis, or a combination thereof in one or more sequences or washing cycles. For example, in some embodiments, the member 20 may engage/disengage from the detergent 2/compartment 3 along the same circumferential path (e.g. at a constant radial length from the rotational axis R), without axial movement in the direction along the rotational axis R. In some embodiments, the rotational movement of the member 20 may be in a first rotational direction (e.g. clockwise), a second rotational direction (e.g. counter clockwise or different from the first rotational direction), or both. In one embodiment, with the specific track pattern 52 as shown in FIG. 1, the rotational movement of the elongated member 20 may be in a counter clockwise rotational direction to rotate from the starting position 6 to the final position 5 following the track 52. Moreover, in some other embodiments, the member 20 or portions thereof may extend radially away from and/or towards the rotational axis R to engage/disengage from the one or more detergent 2/compartments 3. In some other embodiments, the member 20 or portions thereof may extend axially along the rotational axis R towards and/or away from the blister pack 1 to dispense the detergent 2 when in the one or more rotational positions.

In the embodiments as shown here, the rotational positions of the elongated member 20 and/or the backing plate 40 following the track 52, proximate the one or more detergent 2/compartment 3 and/or the outlet 42 to dispense the detergent 2 from the blister pack 1, may be a variety of rotational positions or degrees θ between positions. Moreover, in some embodiments, the rotational positions may be between or spaced from the detergent 2/compartment 3 and therefore do not have to be proximate the detergent 2/compartment 3 in each rotational position. In some embodiments, the elongated member 20 and/or the backing plate 40 may rotate in the same or different rotational directions/positions and/or degrees of rotation. The spacing or degrees between rotational positons of the elongated member 20 and/or the backing plate 40 may be the same, but may be different in some embodiments. Moreover, the elongated member 20 and/or the backing plate 40 may rotate together or rotate independently from each other to a variety of rotational positions.

Moreover, in some embodiments, the member 20 or detergent dispenser 30 may include one or more one-way bearings 21. The one way bearing, if used, allows the driving mechanism 70/shaft 72 to turn one or more portions of the detergent dispenser in single rotational direction, but not the other rotational direction when the shaft 72 reverses or changes rotational direction. For example, if the member 20 includes a one-way bearing 21 engaging the shaft 72, the member 20 may only rotate in the clockwise or first rotational direction to a first plurality of rotational positions, and not the counterclockwise direction. In various embodiments, the driving mechanism 70 may rotate at least the backing plate 40, the member 20, or both between multiple rotational positions and/or directions. It should be understood that other forms of movement of the member 20 and/or the backing plate 40 (e.g., linear movement) may also be acceptable besides rotation.

In some embodiments, the detergent dispenser 30 may include one or more dispensing devices 60 to variably control the ejection mechanism. In some embodiments, the member 20 may include one or more dispensing devices 60 for one or more applications. For example, as shown in FIGS. 2-4, the second end 23 of the elongated member 20 may include the dispensing device 60 to dispense detergent. In such embodiments, the dispensing device 60 may control the variable length (e.g. radial and/or axial) of the member 20 to expel the detergent 2. Alternatively, the dispensing device 60 may be driven by the driving mechanism 70 along with the member 20 to the plurality of positions to dispense the detergent 2. In some embodiments, the dispensing device 60 may be a solenoid (e.g. electric, linear, etc.) to actively push the detergent 2 out of the compartment 3 in the blister pack 1 to dispense detergent into the wash tub 16. For example, the driving mechanism 70 may drive the solenoid dispensing device 60 at the position proximate the detergent 2/compartment 3 through the movement of the member 20 and/or the backing plate 40, the solenoid dispensing device 60 may then push a pawl/lever and/or release a ratcheted segment to eject the detergent 2 into the wash tub 16. In some embodiments, the dispensing device 60 may not be required to completely push the detergent 2 out of the compartment 3. For example, the dispensing device 60 may be configured to be sufficient to destroy at least part of the walls of the compartment 3 by operating a piercing mechanism, and the detergent 2 may fall into the wash tub 16 under gravity.

In some embodiments, the member 20 may include a plurality of dispensing devices 60. In some embodiments, the dispensing device 60 at the second end 23 of the elongated member 20 may be spaced (e.g. radially) from each other along the elongated member 20 and/or the backing plate 40 to engage and expel detergent 2 at multiple radial distances from the rotational axis R. The dispensing device 60 at the second end 23 may vary the axial length at the same or different times at their respective radial distances from the rotational axis. For example, a first dispensing device 60 may be positioned at a first radial distance or radius from the rotational axis R, and a second dispensing device 60 may be positioned at a second radial distance or radius less than the first radial distance. In different embodiments, the first end 22 or portions of the elongated member 20 may also include the one or more dispensing devices 60.

In some embodiments, as shown in FIGS. 2A, 3A, and 4A, the dispensing device 60 may include one or more rollers 24. The roller 24, if used, may contact the compartment 3 and/or detergent 2 to dispense the detergent 2 towards the backing plate 40 into the wash tub 16. In some embodiments, the roller 24 may be cylindrical in shape. The cylindrical axis of the roller 24 may be transverse (e.g. perpendicular) to the rotational axis R of the motor shaft 72. Moreover, the roller 24 may rotate independently of the remaining portion of the member 20. Alternatively, in some embodiments, the roller 24 may be stationary or fixed relative to the remaining portion of the member 20. In some embodiments, the second end 23 or portions of the elongated member 20 may include one or more rollers 24. It should be understood that that the driving mechanism 70 may drive the member 20 and/or the backing plate 40 in multiple positions and/or directions, so that at any point during the movement, at least one of the outlet 42, the roller 24, the dispensing device 60, and/or portion of the member 20 may be positioned proximate at least one of the detergent 2/compartment 3 for the detergent dispensing. It should be also noted that the roller 24 may be in any feasible forms, configurations, and shapes (e.g., a wedge-shaped sliding element) without departing from the present disclosure.

In some embodiments, as shown in FIGS. 2-4, the member 20 of the detergent dispenser 30 may include at least one actuator 62 to adjust at least a portion of the detergent dispenser 30 (e.g. the member 20, the backing plate 40, etc.). For example, the elongated member 20 may have one or more actuators 62 configured to vary a radial length, vary an axial length parallel to the rotational axis R, or both to dispense or eject the detergent 2. In such embodiments, the actuator 62 may linearly vary a portion of the member 20 or the second end 23 between one or more radial lengths (e.g. RL1, RL2, etc.) to engage/disengage the second end 23, the dispensing device 60, or the roller 24, with the detergent 2/compartment 3. For example, the actuator 62 may vary the radial length of the elongated member 20 away from or towards the rotational axis R (e.g. lengthen and/or shorten). The one or more dispensing devices 60 may extend the elongated member 20 or the second end 23 between a first radial length RL1 and a second radial length RL2 as shown in FIGS. 2 and 3. For example, the first radial length RL1 may be larger to engage a larger circumference or a first radius R1 on the curved track 52 than the second radial length RL2 to engage a smaller circumference or a second radius R2. In various embodiments, the actuator 62 may extend a portion or second end 23 of the elongated member 20 axially or parallel to the rotational axis R. It should be understood that the detergent dispenser 30 may include additional actuators 62 configured to adjust a position of the one or more dispensing devices 60 among the plurality of rotational position to dispense the detergent 2 into the wash tub 16.

In some embodiments, as shown in FIGS. 2-4, the actuator 62 may include a spring. For example, the actuator 62 may be a user-pretensioned spring (e.g. a helical compression or tension spring, a conical spring, etc.) that may allow a retraction energy provided by a user to adjust the position of the dispensing device 60 among the plurality of rotational portions on the track 52 to dispense detergent into the wash tub 16. In use, after placing the blister pack 1 in position between the track plate 50 and the backing plate 40, a user may pretension the spring actuator 62 against the starting position 6 on the curved track 52 of the track plate 50 before starting the washing operation. With both the curved track 52 and the blister pack 1 in the multiple concentric rings configuration, one concentric ring of the detergent 2/compartment 3 in the blister pack 1 may be finished after multiple washing cycles. Then, the spring load of the spring actuator 62 may shorten the rotation radius where the dispensing device 60 located at the second end 23 of the elongated member 20 operates, following the linear radial offset 4 of the curved track 52. Once the entirety of the detergent 2/compartment 3 in the blister pack 1 is finished, and the curved track 52 in the concentric ring configuration reaches the final position 5, a new blister pack 1 may be replaced by the user.

For resetting the actuator 62 after the replacement of the blister pack 1 (i.e. resetting the length of the elongated member 20 to the starting position 6 on the curved track 52), some certain actions may be required to apply on the actuator 62. As the use may need to replace the blister pack 1 anyway before resetting, it may be possible to use the interaction input from the user (e.g., re-pretension the spring by the user) for such resetting operations in some embodiments. For example, the spring load of the spring actuator 62 may be overcome by handling of a user to reset the elongated member 20 back to its full extension from the final position 5 to the starting position 6, following the extended linear radial offset 7, after replacing the blister pack 1. In such a manner, the construction of the actuator 62 may be simpler and more reliable, as no resetting mechanism is needed to be built in the actuator 62 itself. It should be understood that other feasible devices may be used for the resetting of the actuator 62. For example, a motor or solenoid may be adapted to force the extension of the spring such resetting operations.

In various embodiments, the backing plate 40 may be either stationary or fixed. In some embodiments as shown in FIG. 1, if the backing plate 40 and/or the blister pack 1 is fixed, and only the member 20 is moving, a plurality of outlets 42 may be positioned proximate each detergent 2/compartment 3 of the blister pack 1 to be in communication with the wash tub 16. In such embodiments, the detergent dispenser 30 may include stationary blister pack 1 and backing plate 40 with a plurality of outlets 42. The motor shaft 72 may drive the elongated member 20 in a variety of rotational positions through the stationary blister pack 1. With the blister pack 1 and backing plate 40 being stationary in this one embodiment, the elongated member 20 may dispense the detergent(s) at the one or more rotational positions from the blister pack 1 through the one or more outlets 42 of the backing plate 40 into the wash tub 16.

Figure 1A:
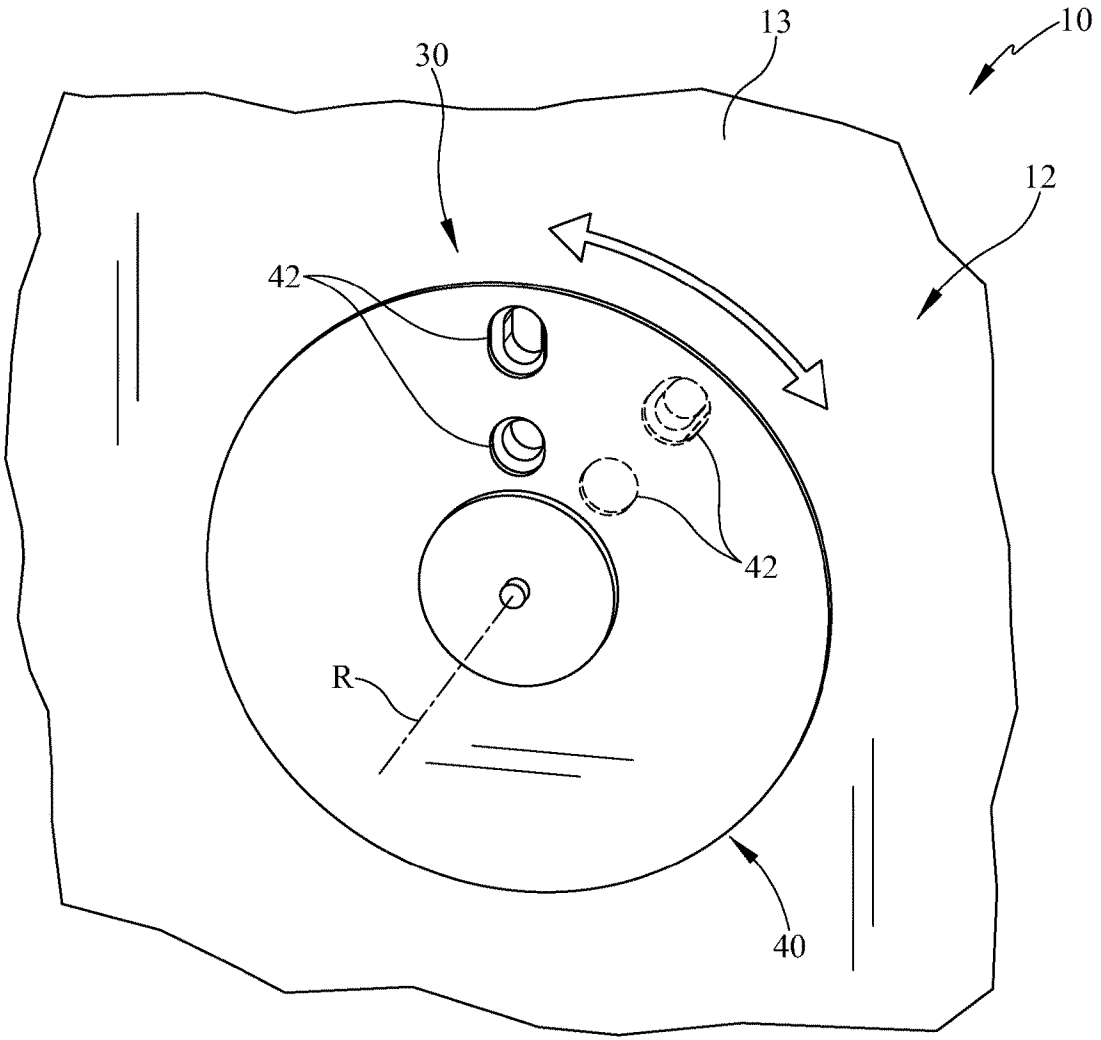
FIG. 1A is a partial rear perspective interior view of a dishwasher illustrating a rotating back plate, according to an embodiment of the present disclosure.

In some other embodiments, as shown in FIG. 1A, the backing plate 40 and/or outlets 42 may rotate about the rotational axis R (e.g. the driving mechanism 70 or the shaft 72) between a plurality of rotational positions to be proximate or expel the detergent 2 and/or compartment 3. The backing plate 40, if rotatable, may engage the shaft 72 or driving mechanism 70 and rotate with the shaft 72 between the rotational positions to position the one or more outlets 42 proximate or in communication with the elongated member 20 (e.g. the second end 23, the roller 24, or the dispensing device 60) in the rotational positions. For example, as shown in FIG. 1A, one outlet 42 may be at the first radius R1 proximate a plurality of detergents 2 at a larger radius of the blister pack 1 and another outlet 42 may be at the second radius R2 proximate a plurality of detergents 2 at a smaller radius of the blister pack 1. In those embodiments that the backing plate 40 or portions thereof rotate about the rotational axis R, the backing plate 40 may rotate in one or more rotational directions. In some embodiments, the dishwasher 10 may spray water or other liquid into the one or more outlets 42 in order to wash the detergent from the detergent dispenser 30 or backing plate 40. It should be understood that the backing plate 40 and/or outlets 42 may be a variety of shapes, sizes, quantities, and constructions and still be within the scope of the present disclosure.

In some implementations, a housing 32 as shown in FIG. 4 (e.g. compartment and/or lid) within the wash tub 16 may (removably or fixedly) receive the detergent dispenser 30. In some embodiments, the housing 32 may be a separate component of the detergent dispenser 30 separable from the dishwasher 10; while in other embodiments, the housing 32 may be incorporated (e.g. by molding or the like) directly into the door 12 of the dishwasher 10. The housing 32 (e.g. a lid or cover dispose over the backing plate or dispenser) may additionally include a dispensing outlet or ejection window configured to guide or direct the detergent contained in each detergent blister pack 1 to the proper location within the wash tub 16 when dispensed from the backing plate 40. In some embodiments, the detergent dispenser 30 or portions thereof may be removable from the housing 32 or the dishwasher door 12 so that a user may load another detergent blister pack 1 or clean the detergent dispenser 30. The backing plate 40 and/or a cover (not shown) of the housing 32 with ejection window disposed over the backing plate or dispenser may be opened and a new or unused detergent blister pack 1 may be installed and cover and/or the backing plate 40 subsequently closed with the dishwasher door 12. As shown in FIG. 4, the detergent dispenser 30 or the backing plate 40 may additionally include a seal or compression seal 31 designed to minimize or prevent entry of water or other liquid into the detergent dispenser. In some instances, these seals may utilize compression forces in order to seal the backing plate 40 or the housing 32. For example, the seal 31 may be positioned between the backing plate and the door 12 or the interior of the door 13.

In some embodiments, the dishwasher 10 may be under the control of a controller that receives inputs from a number of components and drives a number of components in response thereto. The controller may for example, include one or more processors and a memory (not shown) within which may be stored program code for execution by the one or more processors. The memory may be embedded in the controller, but may also be considered to include volatile and/or non-volatile memories, cache memories, flash memories, programmable read-only memories, read-only memories, etc., as well as memory storage physically located elsewhere from the controller, e.g., in a mass storage device or on a remote computer interfaced with controller.

The controller may be interfaced with various components of the dishwasher 10, including an inlet valve that is coupled to a water source to introduce water into the wash tub 16, which when combined with detergent, rinse agent and/or other additives, forms various wash fluids. The controller may also be coupled to a heater that heats fluids, a pump that recirculates wash fluid within the wash tub by pumping fluid to the wash arms and other spray devices in the dishwasher, an air supply that may provide a source of pressurized air for use in drying utensils in the dishwasher, a drain valve that is coupled to a drain to direct fluids out of the dishwasher, and a diverter that controls the routing of pumped fluid to different spray arms and/or other sprayers during a washing cycle.

The controller may also be coupled to the detergent dispenser 30 to trigger the dispensing of detergent into the wash tub at appropriate points during a washing cycle. More particularly, the controller may be coupled to the driving mechanism 70 (e.g. a motor) of the detergent dispenser 30, which may include one or more micro switches or a stepper motor in order to control and/or determine the rotational positioning or direction of the various member 20, the dispensing device 60, and/or the backing plate 40. The dispensing device 60 may also be coupled to the controller to dispense and/or engage/disengage the member 20 or portions thereof (e.g. radially and/or axially, etc.). Additional sensors and actuators may also be used in some embodiments, including a temperature sensor to determine a wash fluid temperature, a door switch to determine when the dishwasher door 12 is latched, and a door lock to prevent the door from being opened during a washing cycle. If used, a break beam sensor or other suitable sensors may be used to detect tablet ejection from the detergent dispenser 30 and/or the outlet 42 of the backing plate 40, etc. The tablet or detergent 2 dispensed from the detergent blister pack 1 may break the beam upon ejection. Moreover, the controller may be coupled to a user interface including various input/output devices such as knobs, dials, sliders, switches, buttons, lights, textual and/or graphics displays, touch screen displays, speakers, image capture devices, microphones, etc. for receiving input from and communicating with a user. In some embodiments, the controller may also be coupled to one or more network interfaces, e.g., for interfacing with external devices via wired and/or wireless networks such as Ethernet, Bluetooth, NFC, cellular, and other suitable networks.

Moreover, in some embodiments, at least a portion of the controller may be implemented externally from the dishwasher 10, e.g., within a mobile device, a cloud computing environment, etc., such that at least a portion of the functionality described herein is implemented within the portion of the controller that is externally implemented. In some embodiments, the controller may operate under the control of an operating system and may execute or otherwise rely upon various computer software applications, components, programs, objects, modules, data structures, etc. In addition, the controller may also incorporate hardware logic to implement some or all of the functionality disclosed herein. Further, in some embodiments, the sequences of operations performed by the controller to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the present disclosure applies equally regardless of the particular type of computer readable media used to actually carry out the distribution, including, for example, non-transitory computer readable storage media. In addition, it should be understood that the various operations described herein may be combined, split, reordered, reversed, varied, omitted, parallelized and/or supplemented with other techniques known in the art, and therefore, the present disclosure is not limited to the particular sequences of operations described herein.

In some embodiments, there may be multiple micro switches to determine at which point the detergent dispenser 30 reaches a resettable position to change the direction of motor operation and/or to replace the blister pack 1. For example, one or more intermittent switches may be provided proximate the final position 5 on the track 52, and one or more micro switches may trigger a "reload" button to light on the dishwasher 10 to remind the user to replace the blister pack 1 and reset the ejection mechanism of the dispenser 30. It should be understood that any other feasible devices, such as a break beam laser or a reed switch assembly, may also be used here.

It should be understood that the detergent dispensing mechanism described here could vary greatly and still accomplish the same intent. The elements depicted in the accompanying figures may include additional components and that some of the components described in those figures may be removed and/or modified without departing from scopes of the elements disclosed herein. The elements depicted in the figures may not be drawn to scale and thus, the elements may have different sizes and/or configurations other than as shown in the figures. Various additional modifications may be made to the illustrated embodiments consistent with the present disclosure. Therefore, the present disclosure lies in the claims hereinafter appended.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

The invention claimed is:

1. A dishwasher comprising:

a wash tub; and a detergent dispenser positioned in said wash tub to dispense detergent into said wash tub, said detergent dispenser including a driving mechanism with a rotating shaft defining a rotational axis;

an elongated member having a first end coupled to said rotating shaft and a second end projecting radially outward therefrom;

a track plate having a first side, a second side, and a curved track thereon disposed about said rotational axis, said curved track for receiving said second end of said elongated member;

a backing plate having a first side and a second side, said backing plate having one or more outlets on said second side therethrough in fluid communication with said wash tub;

a blister pack for coupling between said second side of said track plate and said first side of said backing plate, said blister pack having a plurality of detergents arranged in a configuration complementary to said curved track;

wherein said driving mechanism rotates said elongated member on said first side of said track plate with respect to said track plate and said blister pack together along a plurality of rotational positions following said curved track, and one or more of said plurality of rotational positions orientates said second end of said elongated member proximate said plurality of detergents to dispense detergent into said wash tub through said one or more outlets of said backing plate;

wherein said elongated member further comprises one or more dispensing devices proximate said second end, wherein said one or more dispensing devices are rotated to said plurality of rotational positions to dispense detergent into said wash tub;

wherein said elongated member further comprises one or more actuators configured to adjust a position of said one or more dispensing devices among said plurality of rotational positions to dispense detergent into said wash tub;

wherein said curved track is a plurality of non-overlapping concentric rings with a plurality of rotating radiuses about said rotational axis;

wherein said curved track further comprises one or more linear radial offsets among said plurality of non-overlapping concentric rings;

wherein said one or more actuators automatically adjust a length of at least a portion of said elongated member in a direction perpendicular to said rotational axis to match said plurality of rotating radiuses.

2. The dishwasher of claim 1, wherein said one or more dispensing devices comprise a solenoid configured to actively push said plurality of detergents out of said blister pack to dispense detergent into said wash tub.

3. The dishwasher of claim 1, wherein said one or more dispensing devices comprise a roller or wedge.

4. The dishwasher of claim 1, wherein said one or more actuators comprise a spring.

5. The dishwasher of claim 1, wherein said one or more actuators are configured to adjust said length of said elongated member to a rotating radius among said plurality of rotating radiuses following said linear radial offset of said curved track during operation.

6. The dishwasher of claim 5, wherein one or more actuators are configured to reset said length of said elongated member to a different rotating radius among said plurality of rotating radiuses.

7. The dishwasher of claim 1, wherein said backing plate rotates along with said elongated member about said rotational axis.

8. The dishwasher of claim 7, wherein said backing plate rotates along said plurality of rotational positions positioning said one or more outlets proximate said elongated member.

9. The dishwasher of claim 1, wherein said driving mechanism comprises a stepper motor.

10. The dishwasher of claim 1, further comprising one or more intermittent switches proximate at least one position on said curved track.

11. A dishwasher comprising:

a wash tub; and a detergent dispenser positioned in said wash tub to dispense detergent into said wash tub, said detergent dispenser including a driving mechanism with a rotating shaft defining a rotational axis;

an elongated member having a first end coupled to said rotating shaft and a second end projecting radially outward therefrom;

a track plate having a curved track thereon disposed about said rotational axis, said curved track for receiving said second end of said elongated member;

a backing plate having one or more outlets therethrough in fluid communication with said wash tub;

a blister pack for coupling between said track plate and said backing plate, said blister pack having a plurality of detergents arranged in a configuration complementary to said curved track;

wherein said driving mechanism rotates said elongated member with respect to said track plate along a plurality of rotational positions following said curved track, and one or more of said plurality of rotational positions orientates said plurality of detergents proximate said second end of said elongated member to dispense detergent into said wash tub through said one or more outlets of said backing plate;

wherein said elongated member further comprises one or more actuators to vary a radial length to dispense one or more of said plurality of detergents.

12. The dishwasher of claim 11, wherein said backing plate rotates along with said blister pack with said shaft of said driving mechanism about said rotational axis.

13. The dishwasher of claim 11, wherein said one or more actuators vary an axial length parallel to said rotational axis to dispense one or more of said plurality of detergents.

14. A dishwasher comprising:

a wash tub; and a detergent dispenser positioned in said wash tub to dispense detergent into said wash tub, said detergent dispenser including a driving mechanism with a rotating shaft defining a rotational axis;

an elongated member having a first end coupled to said rotating shaft and a second end projecting radially outward therefrom;

a track plate having a first side, a second side, and a curved track thereon disposed about said rotational axis, said curved track for receiving said second end of said elongated member;

a backing plate having a first side and a second side, said backing plate having one or more outlets on said second side therethrough in fluid communication with said wash tub;

a blister pack for coupling between said second side of said track plate and said first side of said backing plate, said blister pack having a plurality of detergents arranged in a configuration complementary to said curved track;

wherein said driving mechanism rotates said elongated member on said first side of said track plate with respect to said track plate and said blister pack together along a plurality of rotational positions following said curved track, and one or more of said plurality of rotational positions orientates said second end of said elongated member proximate said plurality of detergents to dispense detergent into said wash tub through said one or more outlets of said backing plate;

wherein said elongated member further comprises one or more dispensing devices proximate said second end, wherein said one or more dispensing devices are rotated to said plurality of rotational positions to dispense detergent into said wash tub;

wherein said one or more dispensing devices comprise a solenoid configured to actively push said plurality of detergents out of said blister pack to dispense detergent into said wash tub.

15. A dishwasher comprising:

a wash tub; and a detergent dispenser positioned in said wash tub to dispense detergent into said wash tub, said detergent dispenser including a driving mechanism with a rotating shaft defining a rotational axis;

an elongated member having a first end coupled to said rotating shaft and a second end projecting radially outward therefrom;

a track plate having a first side, a second side, and a curved track thereon disposed about said rotational axis, said curved track for receiving said second end of said elongated member;

a backing plate having a first side and a second side, said backing plate having one or more outlets on said second side therethrough in fluid communication with said wash tub;

a blister pack for coupling between said second side of said track plate and said first side of said backing plate, said blister pack having a plurality of detergents arranged in a configuration complementary to said curved track;

wherein said driving mechanism rotates said elongated member on said first side of said track plate with respect to said track plate and said blister pack together along a plurality of rotational positions following said curved track, and one or more of said plurality of rotational positions orientates said second end of said elongated member proximate said plurality of detergents to dispense detergent into said wash tub through said one or more outlets of said backing plate;

wherein said elongated member further comprises one or more dispensing devices proximate said second end, wherein said one or more dispensing devices are rotated to said plurality of rotational positions to dispense detergent into said wash tub;

wherein said one or more dispensing devices comprise a roller or wedge.

* * * * *